United States Patent [19]

Dubois et al.

[11] Patent Number: 4,682,970

[45] Date of Patent: Jul. 28, 1987

[54] FIGURE TOY WITH EXTENSIBLE HEAD PORTION

[75] Inventors: Craig Dubois, Granby, Conn.; Brian Fontaine, Southbridge, Mass.

[73] Assignee: Coleco Industries, Inc., West Hartford, Conn.

[21] Appl. No.: 826,845

[22] Filed: Feb. 6, 1986

[51] Int. Cl.[4] ..... A63H 3/36

[52] U.S. Cl. ..... 446/309; 446/320; 446/340; 446/368

[58] Field of Search ..... 446/309, 320, 330, 368, 446/340, 304, 338, 300, 336, 308

[56] References Cited

U.S. PATENT DOCUMENTS

| | | | |
|---|---|---|---|
| 188,841 | 3/1877 | Baxter . | |
| 699,780 | 5/1902 | Woerner . | |
| 2,614,365 | 10/1952 | Musselwhite et al. . | |
| 3,053,008 | 9/1962 | Pelunis . | |
| 4,236,346 | 12/1980 | Iwao . | |
| 4,244,138 | 1/1981 | Holahan et al. . | |
| 4,301,615 | 11/1981 | Ikeda . | |
| 4,469,327 | 9/1984 | Ulrich et al. . | |
| 4,526,552 | 7/1985 | Rhodes . | |
| 4,530,671 | 7/1985 | Mednick et al. . | |
| 4,561,854 | 12/1985 | Amici et al. | 446/340 X |

FOREIGN PATENT DOCUMENTS

| | | | |
|---|---|---|---|
| 987553 | 4/1951 | France | 446/309 |
| 1115509 | 1/1956 | France | 446/309 |

*Primary Examiner*—Kenneth Downey

[57] ABSTRACT

A toy creature figure has an extensible neck on which is mounted a head that is thrust upwardly as the neck is propelled forwardly. The mechanisms provided are highly effective for their intended purpose, and manufacture of the toy is relative facile and inexpensive.

10 Claims, 5 Drawing Figures

FIGURE TOY WITH EXTENSIBLE HEAD PORTION

BACKGROUND OF THE INVENTION

An ongoing demand exists for action toys having novel features. It is of course important that any such toy be effective in its appearance and operation, while being durable and relatively facile and inexpensive to manufacture. The prior art discloses numerous forms of action toys in which various parts can be moved in different ways. Typical are the following U.S. patents:

Iwao U.S. Pat. No. 4,236,346 discloses a turtle-like toy wherein the head is mounted for extension by spring power. This is achieved by actuation of plural-mode releasing means, which serves to actuate each of several movable parts.

In the amusement game device of Ulrich et al U.S. Pat. No. 4,469,327, the tail of the dragon-like figure disclosed is manipulated to cause its neck to curl upwardly and rearwardly.

Rhodes U.S. Pat. No. 4,526,552 shows an animated figure wherein a body-mounted blade is caused to extend the head as the upper and lower torso sections are rotated relative to one another.

Mednick et al U.S. Pat. No. 4,530,671 discloses a toy figure wherein the neck can be held frictionally in any of a number of extended positions, due to eccentric disposition of a heavy portion of the skull attached to it.

Baxter U.S. Pat. No. 188,841 discloses a toy in the form of a simulated tortoise, wherein each of two pieces includes a pair of legs, the pieces being pivotable within the body and actuated by a spring-operated propelling wheel.

Woerner U.S. Pat. No. 699,780 shows a foot rest in the form of a turtle, wherein a lazy-tongs arrangement serves to actuate simulated legs.

Musselwhite et al U.S. Pat. No. 2,614,365 and Pelunis U.S. Pat. No. 3,053,008 both disclose dolls in which spring-mounted arms may be actuated in an embracing movement.

Ikeda U.S. Pat. No. 4,301,615 provides a mechanical turtle having legs and a head that extend and retract, and a tail that spins.

It is an object of the present invention to provide a novel toy figure having a unique action feature in the form of an extensible and thrusting head portion.

It is also an object of the invention to provide such a figure wherein a unique mechanism is provided for effecting such action.

An additional object of the invention is to provide such a toy, particularly in the form of a creature figure, which is effective in its appearance and operation, is durable, and is relative facile and inexpensive to manufacture.

THE SUMMARY OF THE INVENTION

It has now been found that certain of the foregoing and related objects of the invention are attained by the provision of a toy figure having a generally hollow body within which is slidably mounted a neck member for movement between first and second positions, substantially along a first axis between the end portions thereof. The neck member has an outer portion which protrudes from the forward end portion of the body in its first position, and which projects further outwardly in the second position thereof. A head member is mounted upon the outer portion of the neck member for pivotal movement about a second axis, which is generally transverse to the first-mentioned axis, also between first and second positions. The head member has a constraining element thereon which contacts the body in the first position of the neck member, to constrain the head member to its first position, and which is spaced from the body in the second position of the neck member to free it from such constraint.

Means is provided for biasing the head and neck members toward the respective second positions thereof; latch means retains the neck member in its first position and is operable to release the neck member for extension to its second position, and means is included to provide access, externally of the body, for effecting release of the latch means. Upon release of the latch means the neck and head member will be extended and thrust, respectively, from the first to the second positions thereof by the biasing means provided.

Generally, the body of the figure will be elongated and will have longitudinally aligned openings at its opposite ends, with the neck member projecting through the forward one of the openings and with the rearward opening comprising the access-providing means for the toy. The neck member will also have an inner end portion disposed within the body, which will have internal structure defining an aperture longitudinally aligned with the forward opening and slidably engaging the neck member portion. Normally, the biasing means will comprise a coil spring disposed on the neck member with its innermost end bearing upon forwardly directed surfaces of the internal body structure.

In the preferred embodiments, the neck member will be formed as a single piece which provides the inner and outer end portions as well as a rearwardly directed abutment surface at the intersection against which the outermost end of the coil spring will bear. Most desirably, the biasing means will include a member separate from the coil spring for the purpose of providing the necessary bias to the coil member.

The latch means will advantageously comprise a latch piece pivotably mounted within the body, and inner end portions of the latch piece and the neck member will have interengaging means thereon for retaining the neck member in its first position; an outer end portion of the latch piece may protrude through the rearward body opening to permit direct finger contact. The interengaging means provided will conveniently comprise a notch on either the latch piece or the neck member and a dog on the other one thereof, and the latch piece will preferably have biasing means integrally formed thereon and bearing upon an inside surface of the body to urge the dog into the notch when the elements are in registry with one another. The toy will usually be in the form of a creature, in which case the outer end portion of the latch piece will simulate a tail thereon.

The neck member may include an abutment element providing the surface against which the biasing means bears, the element being dimensioned and configured to interfere with the portion of the body about its forward opening so as to establish the limit of projection of the neck member in its second position. Generally, the head member will be substantially open at the rear, to receive the neck member outer end portion therethrough, and the constraining means will advantageously take the form of a rearward extension on the upper part of the head member. In most cases, with the body of the figure oriented horizontally, the biasing means will act upon the head member at a level below the pivotal axis on which it is mounted, to impart an upward thrust to the head member in moving toward its second position,

DETAILED DESCRIPTION OF THE ILLUSTRATED EMBODIMENT

Figure 1:
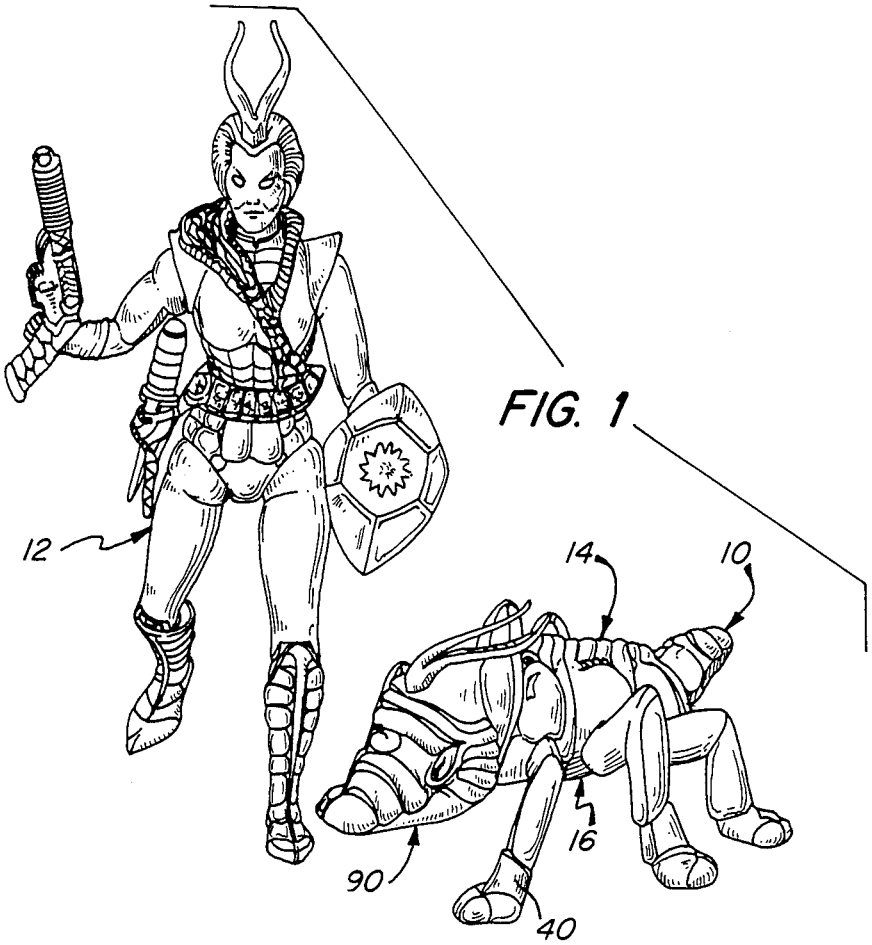
FIG. 1 is a perspective view showing a toy creature figure embodying the present invention, accompanied by a humanoid figure.

Turning now in detail to the appended drawings, FIG. 1 shows a toy creature figure embodying the present invention accompanying a humanoid figure, generally designated respectively by the numerals 10, 12. It will be understood that the science fiction motif for the figures, and the particular character of the creature toy shown, are non-limiting; the toy figure of the invention may of course take any of a wide diversity of forms.

Figure 5:
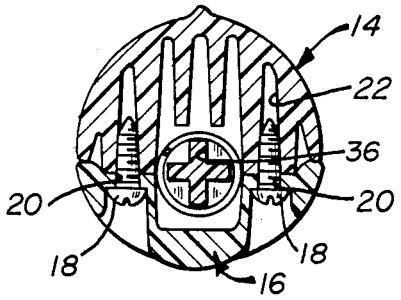
FIG. 5 is a sectional view of the creature toy taken along line 5—5 of FIG. 4.

The body of the toy is generally hollow, and consists of an upper section and a lower (or dorsal and ventral) section, generally designated respectively by the numerals 14, 16, which are held together by self-tapping screws 18 (FIG. 5) provided at appropriate locations and received in suitable holes 20 and bores 22 formed into the body sections. The body has a neck opening 24 and a tail opening 26 formed in its forward and rearward ends, through which extend, respectively, a neck member generally designated by the numeral 28 and a latch member generally designated by the numeral 30. Web elements 32, 34 extend inwardly from from the upper and lower body sections 14, 16, and define therebetween a cruciform aperture 36. Six lateral holes 38 are formed by the body sections along the sides of the figure, and serve to mount leg-simulating appendages 40; head elements 42 on the inner ends of the appendages (seen in FIG. 2) maintain them against disassembly. Although the appendages differ from one another at locations spaced along the length of the body, laterally aligned ones are matched to preserve the symmetrical appearance of the creature.

Figure 4:
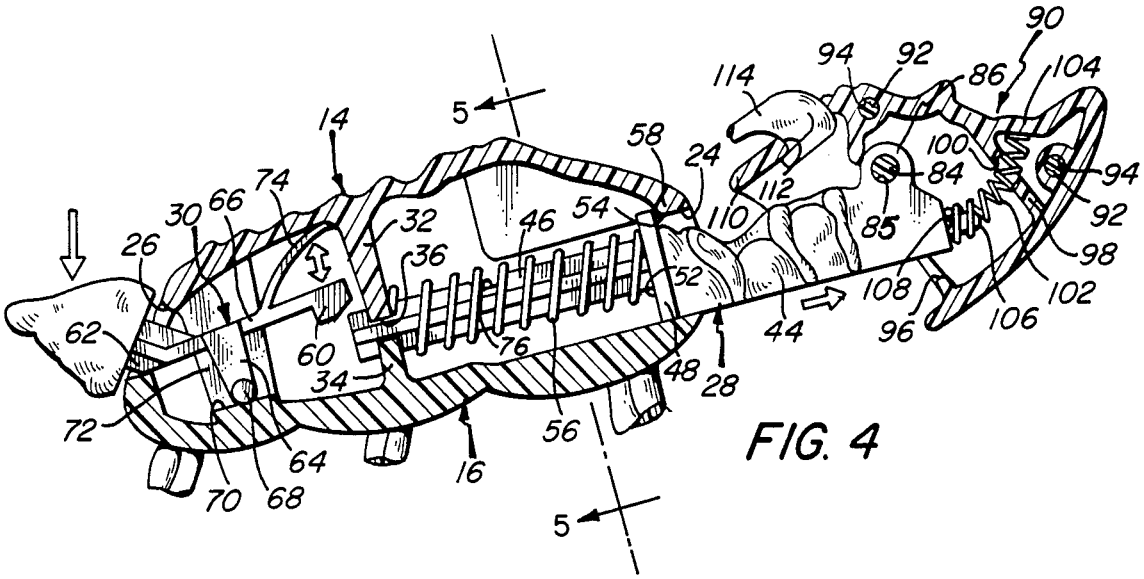
FIG. 4 is a view similar to FIG. 3, showing the head member of the figure in its extended and thrust position.

The neck member 28 has a forward portion 44 which protrudes through the body opening 24, and is configured to simulate a creature neck. The inner end portion 46 is of cruciform cross sectional configuration, and is as a result slidably and nonrotatably engaged within the aperture 36 formed by the body web elements 32, 34. A collar 48 is formed at the juncture between the forward and rearward portions 44, 46 of the one-piece neck member 28, and provides an abutment surface 52 and a peripheral shoulder 54 on the rearward and forward sides thereof, respectively. Coil spring 56 is disposed about the inner end portion 46 of the neck member, with one end bearing upon the surfaces of the web elements 32, 34 and with the opposite end bearing upon the abutment surface 52 of the collar 48; thus, the spring 56 urges the neck member 28 to the outwardly extended position shown in FIG. 4. As is also seen therein, the peripheral shoulder 54 interferes with the elements 58 defining the forward body opening 24, to limit extension of the neck member and prevent its disassembly.

Figure 3:
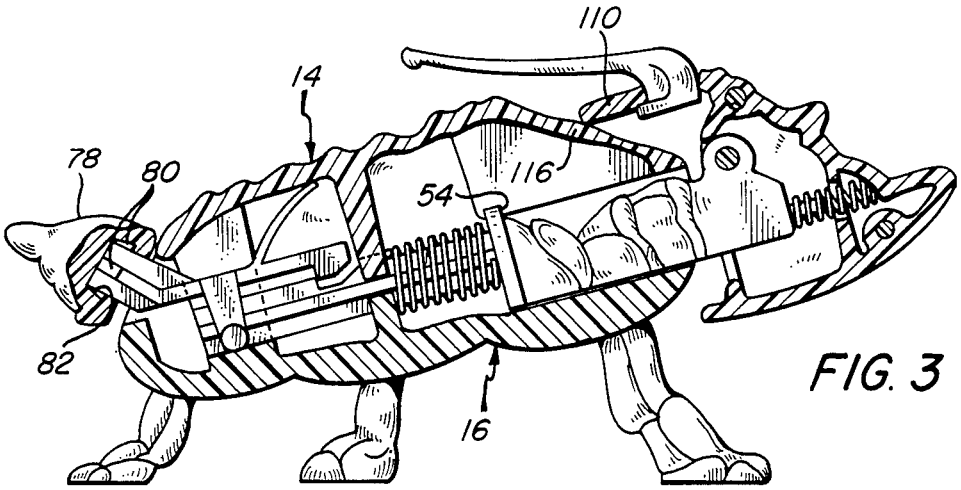
FIG. 3 is a side elevational view of the toy creature figure, with the parts in the relationship shown in FIG. 2 and taken along line 3—3 thereof.

The latch member 30 has a head portion 60 on its innermost end and a tail portion 62 which protrudes through the rearward body opening 26. A pair of pivot arms 64 (only one of which is visible in FIGS. 3 and 4) project in inverted U-shaped form downwardly from opposite sides of the intermediate portion 66 of the latch member, and have trunnion elements 68 extending laterally from the lower ends thereof. The trunnion elements 68 turn upon bearing surfaces 70 provided within the lower body section 16, and are trapped thereagainst by rib elements 72, which extend downwardly from the upper body section 14 and have semicircular recesses in their ends to journal the trunnion elements. An integrally formed resilient leaf element 74 curves upwardly from the intermediate section 66 of the latch member 30 into contact with the overlying inside surface of the body, and provides a downward bias to the head or dog portion 60. The latter is configured to engage within the notch 76 formed into the upwardly oriented rib of the neck member inner portion 46, so as to retain the neck member in its retracted position, as illustrated in FIG. 3. The integral biasing element 74 maintains such interengagement until it's force is overcome by downward pressure upon the tail portion 62. As will be noted, the portion 62 is covered by a cap 78 which is configured to simulate a creature tail, and it has outwardly extending barb elements 80 thereon which engage within the cavity 82 to secure the assembly.

A rod 84 extends transversely through the aperture 85 of a raised cylindrical formation 86 at the forward end of the neck portion 44, and has its outer ends engaged within bores 88 formed into the opposite sides of the creature head member, which is generally designed by the numeral 90. The head member is formed in two mirror-image lateral sections, which are secured to one another after assembly on the pivot rod 84 by appropriate means, such as sonic welding, adhesive bonding, or the like; locating pins 92 and corresponding bores 94 may be used to facilitate assembly. The head member 90 has a relatively large rear opening 96, through which the outer end portion 44 of the neck member 28 is inserted, and internal web elements 98 define a central aperture 100 through which the coil spring 102 is threaded. One end of the spring 102 bears upon the front wall portion 104 of the head member, and the opposite end encircles a small locating pin 106 and bears upon the forward face 108 of the neck member 28. Because of the relative positions of the point of contact of the spring 102 and the axis of pivoting established by the rod 84, the spring will impart an upward bias to the head member 90. An extension piece 110 projects rearwardly at the top of the head member 90, and has an aperture 112 therethrough within which is affixed an antenna-simulating part 114.

Figure 2:
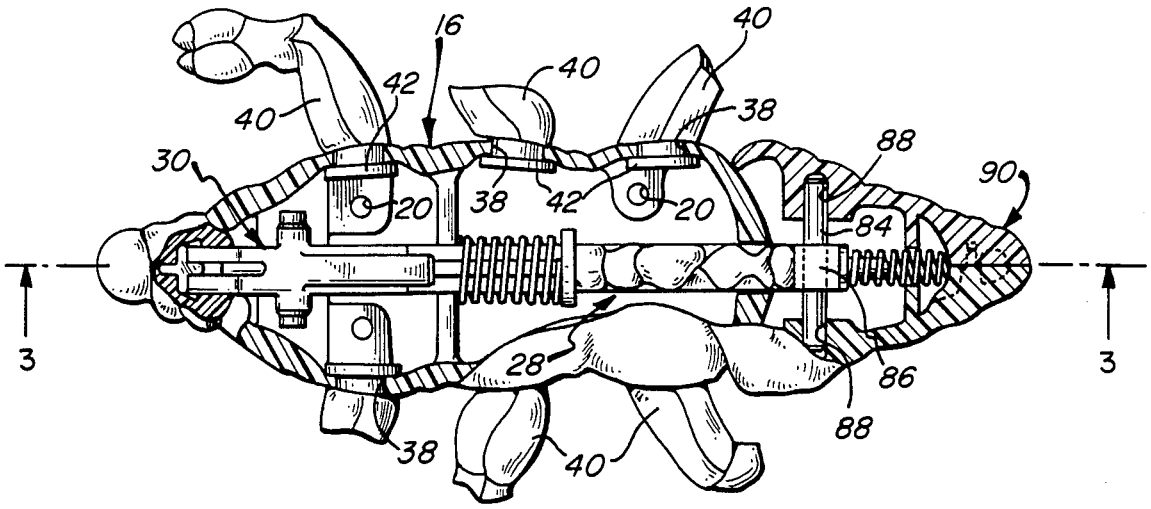
FIG. 2 is fragmentary plan view of the toy creature figure of FIG. 1, shown in partial section and with the head member in its retracted position.

In the closed, or retracted, position of the head and neck members, shown in FIGS. 1–3, the extension piece 110 bears upon a shoulder portion 116 of the upper body section 14, constraining the head member to a downward, forward-facing orientation against the counteracting bias of the coil spring 102. When the neck member 28 is released by pressure upon the tail cap 78 (which disengages the dog portion 60 of the latch member 30 from the notch 76), the neck and head members will be propelled forwardly under the force of the coil spring 56; the extension piece 110 will at the same time move away from the shoulder portion 116, thus permitting the spring 102 to pivot the unrestrained head member upwardly in a thrusting motion.

It will be appreciated that the toy creature figure of the invention may take many different forms, and that the mode of its action may vary from that which has been described, such as by utilizing a mechanism that imparts a downward thrust to the head member. Although suitable materials of construction will be evident to those skilled in the art, it might be pointed out that synthetic resinous materials will normally predominate, and that plastics such as ABS, PVC, and acetal copolymers will typically be used.

Thus, it can be seen that the present invention provides a novel toy figure having a unique action feature in the form of an extensible and thrusting head portion. A unique mechanism is provided for effecting such action, and the toy is effective in its appearance and operation, is durable, and is relative facile and inexpensive to manufacture.

Having described the invention, what is claimed is:

1. A toy figure having an extensible and thrusting head, comprising:

a generally hollow body having forward and rearward end portions;

a neck member mounted within said body for sliding movement between first and second positions substantially along a first axis between said end portions thereof, said neck member having an outer portion which protrudes from said forward end portion of said body in said first position of said member, and which projects further outwardly in said second position thereof;

a head member mounted upon said outer portion of said neck member for pivotal movement about a second axis, which is generally transverse to said first axis, between first and second positions, said head member having a constraining element thereon which contacts said body in said first position of said neck member to constrain said head member to said first position thereof, and which is spaced from said body in said second position of said neck member to free said head member from such constraint;

means for biasing said head and neck members toward said respective second positions thereof;

latch means for retaining said neck member in said first position and operable to release said neck member for extension to said second position thereof; and means for providing access externally of said body for effecting release of said latch means; whereby, upon release of said latch means said neck member and said head member will be extended and thrust, respectively, from said first to said second positions thereof by said biasing means.

2. The figure of claim 1 wherein said body is elongated and has longitudinally aligned openings at its opposite ends, said neck member projecting through the forward one of said openings and the rearward one of said openings comprising said access-providing means.

3. The figure of claim 2 wherein said neck member has an inner end portion disposed within said body, wherein said body has internal structure defining an aperture longitudinally aligned with said forward body opening and slidably engaging said inner end portion of said neck member, and wherein said biasing means comprises a coil spring disposed about said inner end portion with its innermost end bearing upon forwardly directed surfaces of said internal body structure.

4. The figure of claim 3 wherein said neck member is integrally formed, as a single piece, to provide said inner and outer end portions and a rearwardly directed abutment surface at the intersection thereof, wherein the outermost end of said coil spring bears upon said abutment surface, and wherein said biasing means includes a member separate from said coil spring for so biasing said head member.

5. The figure of claim 3 wherein said latch means comprises a latch piece pivotably mounted within said body, wherein an inner end portion of said latch piece and said inner portion of said neck member have interengaging means thereon which are operative to retain said neck member in said first position, and wherein an outer end portion of said latch piece protrudes through said rearward body opening for finger contact.

6. The figure of claim 5 wherein said interengaging means comprises a notch on one of said latch piece and neck member, and a dog on the other one thereof, and wherein said latch piece has biasing means integrally formed thereon and bearing upon an inside surface of said body to urge said dog into said notch when they are in registry with one another.

7. The figure of claim 6 wherein said toy is in the form of a creature, and wherein said outer end portion of said latch piece simulates a tail thereon.

8. The figure of claim 1 wherein said neck member has an abutment element thereon providing said abutment surface, said abutment element being dimensioned and configured to interfere with the portion of said body defining said forward opening to establish the limit of projection of said neck member in said second position thereof.

9. The figure of claim 1 wherein said head member has a rearward extension thereon providing said constraining element, and wherein said head member is substantially open at the rear to receive said neck member outer end portion therethrough.

10. The figure of claim 9 wherein, with said body oriented generally horizontally, said rearward extension is on the upper part of said head member, and wherein said biasing means acts on said head member at a level below said second pivotal axis to thrust said head member upwardly in moving from said first to said second position thereof.

* * * * *